United States Patent [19]

Harvey

[11] Patent Number: 4,815,363

[45] Date of Patent: Mar. 28, 1989

[54] LIFE PROTECTOR ENCLOSURE FOR MINES

[76] Inventor: Charles R. Harvey, P.O. Box 193, Robbins, Tenn. 37852

[21] Appl. No.: 156,466

[22] Filed: Feb. 16, 1988

[51] Int. Cl.[4] ..... F24F 11/00

[52] U.S. Cl. ..... 98/50; 98/1; 299/12; 299/95

[58] Field of Search ..... 98/1, 2, 50, 42.01; 299/12, 95; 296/1 R; 175/86, 219; 166/901

[56] References Cited

U.S. PATENT DOCUMENTS

| | | | |
|---|---|---|---|
| 219,222 | 9/1879 | Coles et al. | 98/50 |
| 3,242,844 | 3/1866 | Smith | 98/1 |
| 3,946,571 | 3/1976 | Pate et al. | 175/219 X |
| 4,353,292 | 10/1982 | Almasi et al. | 98/50 |
| 4,415,051 | 11/1983 | Taylor | 296/64 X |

FOREIGN PATENT DOCUMENTS

| | | | |
|---|---|---|---|
| 704673 | 2/1954 | United Kingdom | 98/50 |

*Primary Examiner*—Harold Joyce

*Attorney, Agent, or Firm*—Pitts and Brittian

[57] ABSTRACT

An enclosure for periodic movement in an underground mine to provide a place for the safety of miners. This enclosure has a frame with an envelope unit attached thereto to define an interior volume for habitating by the miners upon notification of eminent dangerous conditions or immediately after dangerous conditions exist. The evelope has at least one sealable doorway, and contains provisions to sustain habitable conditions for a selected time to permit subsequent escape or rescue. The enclosure is to be located about ninety to one hundred twenty-five yards from areas being worked by miners so as to be easily reached and entered. The size of the help unit enclosure is selected to hold a selected number of miners and the supplies for the selected survival interval. The envelope, in its preferred form, further contains circulating fans, communication equipment and other equipment for the comfort of the miners. External lighting is provided to direct the miners, as well as rescuers, to the enclosure.

20 Claims, 3 Drawing Sheets

LIFE PROTECTOR ENCLOSURE FOR MINES

TECHNICAL FIELD

The present invention relates generally to enclosures to protect personnel from adverse environments, and more particularly to a portable enclosure for use in underground mines to serve as an equal life protector for miners following various types of hazardous events that can occur in those mines.

BACKGROUND ART

In underground mines, particularly coal mines, hazardous events are ever-present danger. There can be explosions, excessive smoke, flooding or just "bad" air, to name a few. For example, pockets of explosive gas (e.g., methane) may be released during the drilling or blasting operations that give rise to several of these hazardous events. In such events, the miners in the proximity of the danger are subjected to conditions that can be deadly. Although miners are provided with a pack-type "self rescuer" breather device, the effectiveness of these devices is an hour at maximum. Also, the packs are of no value in environments of high temperature. Furthermore, the miners are frequently many thousands of feet from an exit and, with attendant visibility problems, cannot easily reach such exits safely. Even if the miners can predict the onset of an explosion or fire, such packs are of little use due to the temperatures/pressures, and the miners cannot move a sufficient distance to avoid serious consequences. While some miners might escape, others are unable to avoid the hazards. Thus, the packs may not provide equal protection to all the miners.

Accordingly, it is an object of the present invention to provide a means for equally protecting the miners within an underground mine from accidental hazards.

It is a further object of the invention to provide an enclosure that is readily accessible to all of the miners, this enclosure being sufficiently mobile so as to be periodically advanced in the mine as mining progresses.

It is another object of the invention to provide a safety enclosure for use by miners when serious hazardous conditions are detected such that life-supporting equipment is available for survival for at least a full day (twenty-four hours).

It is also an object of the invention to provide a safety enclosure or "help" unit wherein is contained means for facilitating rescue of miners using the enclosure following cessation of hazardous conditions in the mine.

These and other objects of the present invention will become more apparent upon a consideration of the drawings that are referred to hereinafter, and to a complete description of those drawings and an explanation of the invention.

DISCLOSURE OF THE INVENTION

In accordance with the present invention, there is provided an equal life protector enclosure or "help" unit for use in underground mines. This enclosure is constructed to withstand the adverse environments produced by accidents such as flooding, explosions, fires, bad air, etc., that can occur. The enclosure is sufficiently mobile such that it can be periodically moved as the mine face moves such that it will be with approximately one hundred yards from a mine face so as to be readily accessible to the miners. Equipment and provisions are contained within the enclosure to sustain life for at least twenty-four hours, and means are provided to direct rescuers to the enclosure when severe hazardous conditions have abated. In the preferred embodiment, means are provided to releasably fasten the enclosure to the mine floor to prevent movement when subjected to mine explosions or other sources of pressure.

BEST MODE FOR CARRYING OUT THE INVENTION

Figure 4:
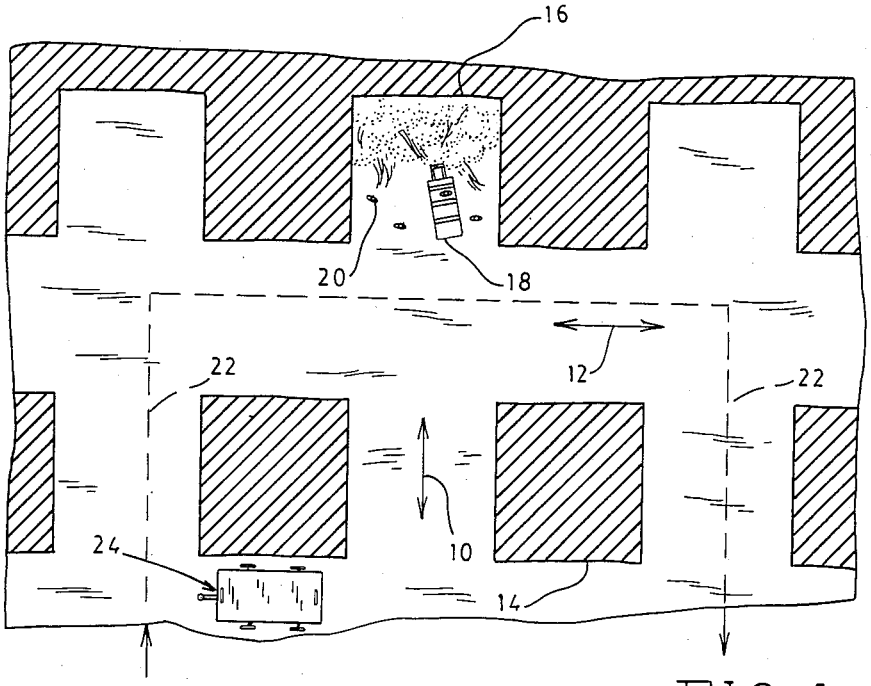
FIG. 4 is a drawing illustrating a portion of a typical layout of an underground mine showing the position of miners and equipment at a mining face, and a typical location of the present invention with respect to that face.

A better understanding of the present invention can be had by first understanding a typical arrangement of an underground mine. Accordingly, by referring to FIG. 4, an underground mine is typically formed by mining "roadways" 10 and "cross cuts" or "breaks" 12 leaving generally square columns 14. At some point there is a working face 16, which face is periodically moved to create an extension of the roadways and further breaks. Typically, there will be various pieces of equipment 18 at this face, and a plurality of miners 20. There are typically ten miners at or near the working face 16; however, there can be more or less than this number in specific mines. Since all underground mines are considered to be "gaseous", forced airflow is produced in a side roadway, with the return along another roadway such that there is a cross-flow of air in a break proximate the working face 16. This airflow is indicated by the arrows on a dashed line 22. This circulation of air is affected with conventional air blowers located near the mine entrance. It is within this airflow, or proximate thereto, that the enclosure of the present invention (indicated at 24) is located such that it will be more removed from any bad air, smoke or the like generated at the working face. Preferably, this enclosure should be ninety to one hundred twenty-five yards from the working face so as to be readily accessible to the miners 20 when dangerous conditions exist.

Figure 1:
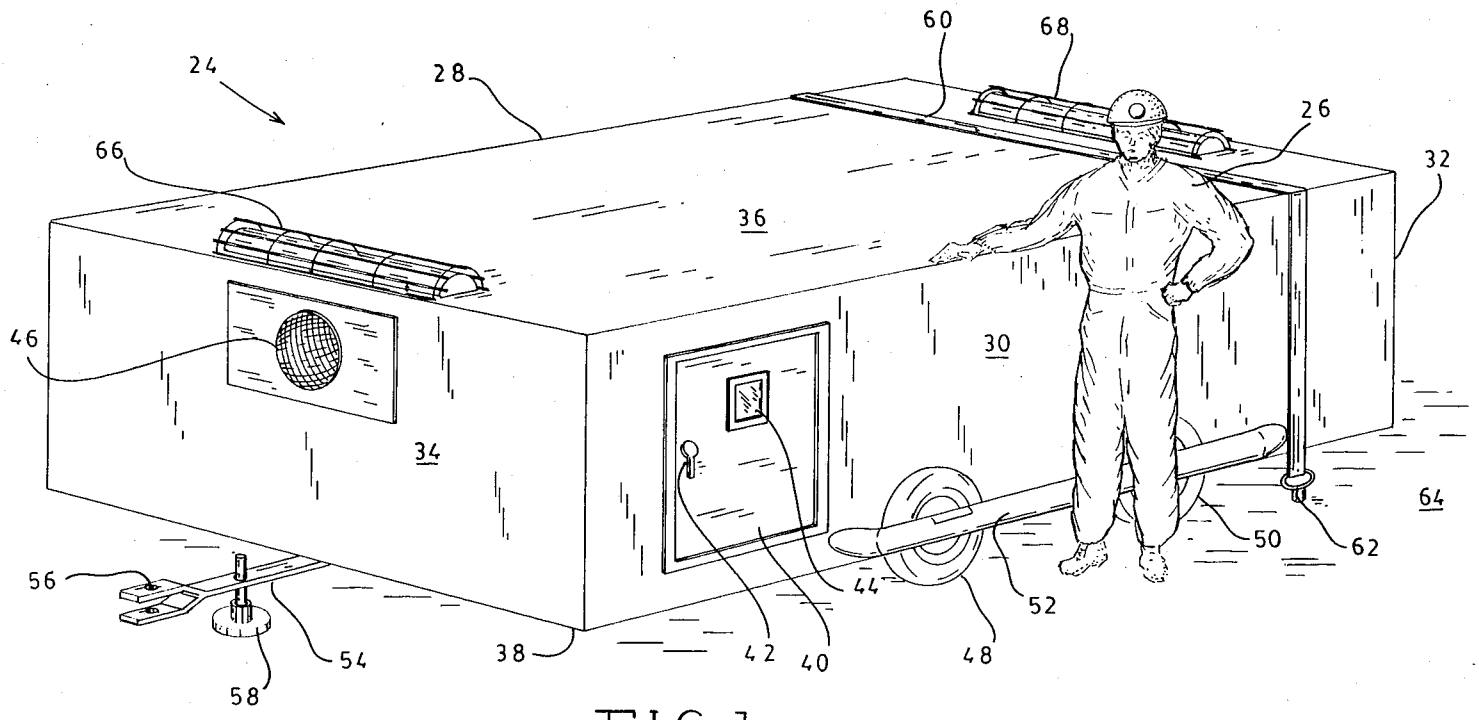
FIG. 1 is a perspective view of a help unit enclosure illustrative of the present invention.

Referring now to FIG. 1, the enclosure 24 of the present invention is illustrated in relationship to a typical miner 26. Although the height of the enclosure is shown as being less than the height of the miner, this is not a limitation of the invention as other heights may be of value in various types of underground mines. The envelope of the enclosure 24 is formed of four walls 28, 30, 32, 34, a top 36 and a bottom 38. At least one of the walls is provided with a door 40, this door having an easily operated handle/latch 42 and a window 44. Since the help unit must be substantially air tight, the door 40 is provided with a peripheral seal 45 (see FIG. 2). Another wall typically is provided with a smoke detector 46. The enclosure 24 typically is about ten feet wide, fifteen feet long and three feet high. This is intended to accommodate up to ten miners. Of course, the enclosure can have other dimensions.

Means are provided to accommodate periodic movement of the enclosure 24 within a mine. In this embodiment, wheels 48, 50 (and corresponding wheels on opposite side) are provided, and a protective "bumper" 52 prevents damage to these wheels as the enclosure is moved. A tongue 54 is pivotally attached to the frame of the enclosure, with an outboard end 56 thereof adapted for releasable attachment to a moving vehicle, e.g., a mine scoop. Typically, there is a support jack 58 carried by the tongue 54 to assist in leveling the help unit and to position the tongue for coupling to the moving vehicle. Preferably at least one tie-down strap 60 is provided for temporary attachment with an anchor bolt 62 to the mine floor 64. Thus, the enclosure is stabilized against movement which otherwise could be caused by pressure waves in the mine. Such tie-down straps 60 would be placed for equal anchoring of both ends of the enclosure 24. Furthermore, light units 66, 68 are provided on the top 36 at opposite ends, these lights serving to guide miners to the help unit 24 and/or directing rescue personnel.

Figure 2:
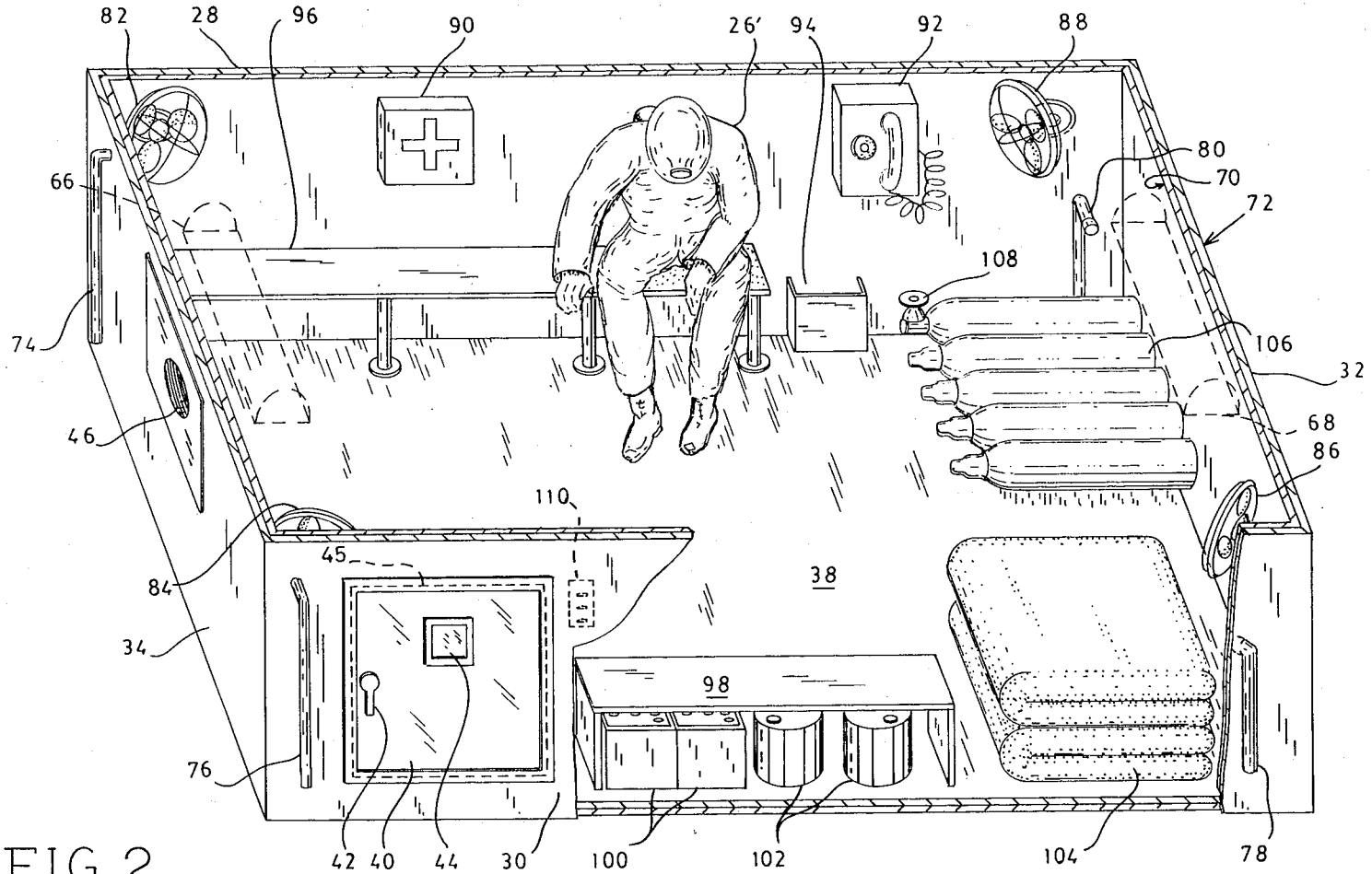
FIG. 2 is a further perspective view of the embodiment of the device of FIG. 1 with the roof portion removed, and a wall portion partially cut away.

Interior features of the enclosure 24 are illustrated in FIG. 2. In this view, the roof is removed, and the wall 30 is partly cut away so as to more clearly show certain features. For clarity, the wheels and tongue are not shown. As will be discussed with more detail in connection with FIG. 3, the walls 28, 30, 32 and 34 have a double layer of insulation as indicated at 70 and 72. Although the floor 38 can have a double layer as shown, such construction may not be necessary; in fact, elimination of the second layer in the floor (and roof) may be desired to reduce total weight of the unit. The enclosure is provided with at least one, and preferably a plurality of, one-way valves such as indicated at 74, 76, 78 and 80. These valves bleed excess interior pressure but prevent flow of air into the enclosure 24 from the surrounding environment. Although not shown, the valves preferably have a protector to prevent damage as the unit is moved.

A plurality of circulating fans, such as at 82, 84, 86 and 88, are mounted on interior walls. Also mounted, as from the walls, is a source 90 of first aid, and communication equipment 92. Various receptacles, as at 94, serve to store maps, etc., or can be collectors of trash. The enclosure further can include one or more benches 96, 98 to support miners 26'. However, the height of some help units will preclude use of benches. Various supplies/equipment can be stored under the benches such as batteries 100 and containers of water 102. Other typical provisions include blankets or sleeping bags 104 as well as a plurality of tanks 106 of oxygen or oxygen-air mixture. An appropriate valve unit 108 is provided to control the addition of the content of the tanks into the enclosure. A switch unit 110 near the door 40 is available for operation by the first miner to enter the enclosure. The switch unit typically controls the fans, lights, etc., with power received from the batteries. Although not shown, a receptacle for human wastes can be provided as part of a bench or located in the floor.

Figure 3:
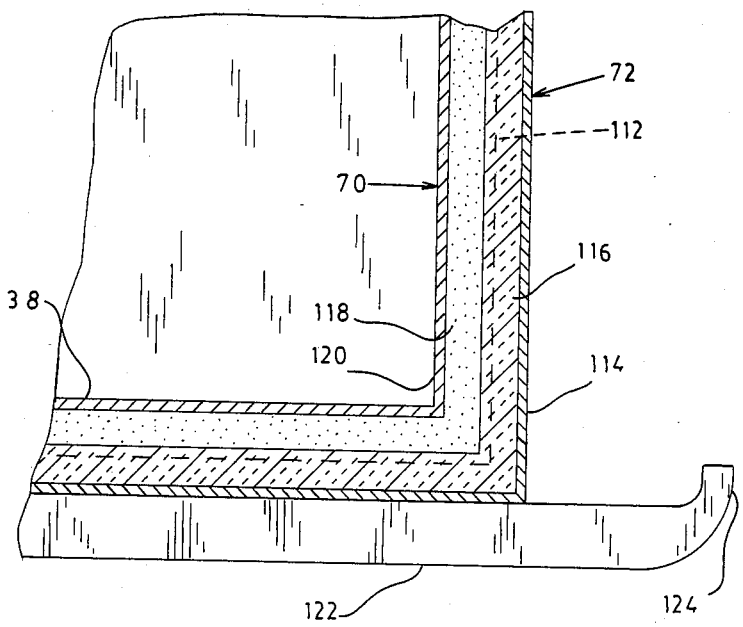
FIG. 3 is a partial cross section of a wall and floor component of the enclosure of FIGS. 1 and 2.

A typical cross-section of the wall portions of the present invention is illustrated in FIG. 3. The wall has a frame structure 112. To this is fastened an external sheath 114 in the form of, for example, ¼ inch thick steel plate to resist external environmental conditions. This sheath is coated on the external surface with a heat and corrosion resistant paint or the like. The remainder of this external wall layer 72 is a high-temperature insulation 116. Typically this insulation can be magnesia (MgO) bricks such as used in kilns. The inner layer 70 is made up essentially of a second layer of insulation 118, such as fiber glass batts, and an inner metallic sheathing 120 of, for example, aluminum. This sheathing of aluminum or other suitable material assists in removing heat from the interior of the help unit. As stated above, the top 36 and the floor 38 can also have a double layer construction as shown; however, only a single layer of the fiber glass may be preferred. A skid 122 is illustrated in this drawing as an alternative to the wheels in FIG. 1. The skid has an up-turned end 124 to facilitate movement across the floor of a mine.

In a normal utilization of the present invention, the enclosure will be positioned within easy reach of miners working at a mining face within an underground mine. The help unit will be from about ninety to about one hundred twenty-five yards from areas where the miners are working at a position to minimize any effect by explosions at the working face: substantially less distance would place the unit where physical damage could occur, and a greater distance would increase the dangers to miners before reaching the unit. The enclosure would be maintained with necessary provisions at all times, and the batteries would be periodically charged to maximum capacity. As the mine face progresses farther into the mine, the enclosure is moved periodically to a proper new position by any suitable moving vehicle.

Upon a warning of impending danger, or even when a dangerous event has occurred, miners in the region of the equal life protector enclosure will enter the device. The first person entering the enclosure (usually the miner travelling the shortest distance) will initiate the fans, lights and any other apparatus. The door 40 is easily opened by a miner but securely closes the opening to prevent ingress of dangerous air. When all of the miners assigned to the enclosure have been accounted for, any other apparatus can be activated as needed. The supplies are designed for habitation up to at least twenty-four hours. Communication with potential rescuers can be made, and the bright amber lights on top of the unit assist in the guidance of those rescuers. The window permits the occupants a view of the environment such that they can leave the enclosure when conditions permit. Further, the smoke detector provides an indication of the condition of the external atmosphere.

From the foregoing it will be understood that a very needed solution has been provided for the safety of miners in underground mines. Instead of a limited one hour "protection" by breathing packs, full protection is given for a full day. This time is only limited by the amount of supplies in the enclosure, principally the oxygen. As stated, the enclosure can be sized for a specific mine dimension, for the number of persons to be housed, and the desired contents. The help unit is designed to be completely "permissive" in the mine: i.e., no component thereof will create a hazard in itself. This is a requirement of all apparatus to be used within the mine.

While certain specific materials are used to describe the present invention and its contents, these are given for illustration purposes only. Thus, the invention is not to be limited by these materials, but is to be limited only by the appended claims and their equivalents when taken together with the full description given herein.

I claim:

1. An enclosure for use in underground mines to provide protection to miners in advance of, or after initiation of, dangerous conditions within said mines, which comprises:

a frame;

a substantially air tight envelope, for safely housing said miners, attached to said frame, said enclosure adapted to exclude environmental conditions related to said dangerous conditions, said envelope provided with at least one closeable opening for ingress and egress by said miners and a door to selectively cover said opening;

means attached to a lower portion of said frame adapted for periodic movement of said enclosure whereby said enclosure is positioned within reach by said miners when said dangerous conditions are eminent or occur; and means contained within said envelope to sustain liveable conditions for said miners for a selected time period.

2. The enclosure of claim 1 wherein said envelope has an external surface characterized by being resistant to environmental conditions external to said envelope, and an internal surface characterized by removing heat from an interior of said envelope, said internal and external surfaces at least partially separated by thermal insulation.

3. The enclosure of claim 2 wherein said external surface is sheet steel, said internal surface is sheet aluminum, and said thermal insulation is a layer of high temperature insulation proximate said sheet steel and batt-type insulation proximate said aluminum sheet.

4. The enclosure of claim 1 wherein said means to sustain liveable conditions includes regulated sources of oxygen-containing gas, sources of drinking water, and means for thermal protection of said miners.

5. The enclosure of claim 1 wherein said enclosure further comprises:

means for circulating air within said envelope;

unidirectional valve means in said envelope for venting excess pressure from said envelope without infiltration of atmosphere external said envelope;

communication means for communicating with exterior said mine; and battery means to power said means for circulating air.

6. The enclosure of claim 1 wherein said door is provided with a latch means operable by said miners, said latch means preventing unintentional opening of said door, and wherein said door is further provided with sealing means around its perimeter to prevent ingress of external environment into said envelope when said door is latched shut.

7. The envelope of claim 5 further comprising external light means, powered by said battery means, attached to said envelope, said light means for assisting said miners in locating said enclosure during said dangerous conditions and for assisting rescuers in locating said enclosure when said dangerous conditions have subsided.

8. The enclosure of claim 5 wherein a smoke detector means powered by said battery means is carried by said envelope, and said door is provided with a glazed window, said detector means and window permitting an assessment by said miners of conditions external said enclosure.

9. The enclosure of claim 1 wherein said means for periodic movement comprises:

wheel means attached to said frame, said wheel means supporting said frame above a floor of said mine; and pivotal tongue means attached to said frame, said tongue means adapted for releasable attachment to a vehicle for moving said enclosure.

10. An enclosure for use in underground mines to provide protection to miners in advance of, or after initiation of, dangerous conditions in said mines, which comprises:

a frame;

a substantially air tight envelope, for safely housing said miners, attached to said frame, said enclosure having an external surface characterized by being resistant to environmental conditions external to said envelope, and an internal surface characterized by removing heat from an interior of said envelope, said internal and external surfaces at least partially separated by thermal insulation, said envelope provided with at least one closeable opening for ingress and egress by said miners and a door to selectively cover said opening;

means attached to a lower portion of said frame adapted for periodic movement of said enclosure whereby said enclosure is positioned within reach by said miners when said dangerous conditions are eminent or occur; and means contained within said envelope to sustain liveable conditions for said miners for a selected time period.

11. The enclosure of claim 10 wherein said external surface is sheet steel, said internal surface is sheet aluminum, and said thermal insulation is a layer of high temperature insulation proximate said sheet steel and batt-type insulation proximate said aluminum sheet.

12. The enclosure of claim 10 wherein said means to sustain liveable conditions includes regulated sources of oxygen-containing gas, sources of drinking water, and means for thermal protection of said miners.

13. The enclosure of claim 10 wherein said enclosure further comprises:

means for circulating air within said envelope;

unidirectional valve means in said envelope for venting excess pressure from said envelope without infiltration of atmosphere external said envelope;

communication means for communicating with exterior said mine; and battery means to power said means for circulating air.

14. The enclosure of claim 10 wherein said door is provided with a latch means operable by said miners, said latch means preventing unintentional opening of said door, and wherein said door is further provided with sealing means around its perimeter to prevent ingress of external environment into said envelope when said door is latched shut.

15. The envelope of claim 13 further comprising external light means powered by said battery means attached to said envelope, said light means assisting said miners in locating said enclosure during said dangerous conditions and for assisting rescuers in locating said enclosure when said dangerous conditions have subsided.

16. The enclosure of claim 13 wherein a smoke detector means powered by said battery means is carried by said envelope, and said door is provided with a glazed window, said detector means and window permitting an assessment by said miners of conditions external said enclosure.

17. The enclosure of claim 10 wherein said means for periodic movement comprises:

wheel means attached to said frame, said wheel means supporting said frame above a floor of said mine; and pivotal tongue means attached to said frame, said tongue means adapted for releasable attachment to a vehicle for moving said enclosure.

18. An enclosure for use in underground mines to provide protection to miners in advance of, or after initiation of, dangerous conditions in said mines, which comprises:

a frame;

a substantially air tight envelope, for safely housing said miners, attached to said frame, said envelope defined by wall members, a roof member and a floor member, said envelope having an external sheet metal surface characterized by being resistant to environmental conditions external to said envelope, and an internal surface, said internal and external surfaces separated in at least said wall members by thermal insulation, said envelope provided with at least one closeable opening in a wall member for ingress and egress by said miners, and a door to selectively cover said opening, said door provided with peripheral sealing means, a glazed window and with a latch means operable by said miners, said latch means preventing unintentional opening of said door;

wheel means attached to a lower portion of said frame, said wheel means supporting said frame and said envelope above a floor of said mine;

pivotal tongue means attached to said frame, said tongue means adapted for releasable attachment to a vehicle for periodic movement of said enclosure whereby said enclosure is positioned with reach by said miners when said dangerous conditions are eminent or occur;

air circulation means within said envelope;

unidirectional valve means communicating between said envelope and surrounding environment for venting excessive pressure from said envelope without infiltration of atmosphere external said envelope; and means within said envelope to sustain liveable conditions for said miners for a selected time period, said means including regulated sources of oxygen-containing gas, sources of drinking water and means for thermal protection of said miners.

19. The enclosure of claim 18 further comprising:

communication means within said envelope for communication with external said mine;

light means mounted on said external surface of said envelope, said light means assisting said miners in locating said enclosure during said dangerous conditions and for assisting rescuers in locating said enclosure when said dangerous conditions have subsided; and battery means within said envelope to power said air circulation means and said light means.

20. The enclosure of claim 18 further comprising:

smoke detector means attached to said external surface of said envelope and powered by said battery means;

a jack means attached to said tongue means to support said tongue means above said mine floor; and tie-down means for releasably anchoring said enclosure at selected periodic locations within said mine.

* * * * *